US008074736B2

(12) United States Patent
Sun et al.

(10) Patent No.: US 8,074,736 B2
(45) Date of Patent: Dec. 13, 2011

(54) PNEUMATIC TOOL WITH AN IMPROVED SOUNDPROOF DEVICE

(75) Inventors: Yung-Yung Sun, Dali (TW); Chuan-Ching Cheng, Taiping (TW)

(73) Assignee: Storm Pneumtic Tool Co., Ltd., Dali, Taichung County (TW)

( * ) Notice: Subject to any disclaimer, the term of this patent is extended or adjusted under 35 U.S.C. 154(b) by 185 days.

(21) Appl. No.: 12/453,575

(22) Filed: May 15, 2009

(65) Prior Publication Data

US 2010/0288522 A1 Nov. 18, 2010

(51) Int. Cl.

| | |
|---|---|
| ***E21B 3/00*** | (2006.01) |
| ***E21B 17/22*** | (2006.01) |
| ***E21B 19/16*** | (2006.01) |
| ***E21B 19/18*** | (2006.01) |

(52) U.S. Cl. ..... 173/219; 173/218

(58) Field of Classification Search ..... 173/211, 173/219, 168–169; 137/625.47; 227/130; 418/270

See application file for complete search history.

(56) References Cited

U.S. PATENT DOCUMENTS

| | | | | | |
|---|---|---|---|---|---|
| 4,121,840 | A * | 10/1978 | Berg | 277/520 |
| 4,487,274 | A * | 12/1984 | Hurt | 173/207 |
| 4,773,487 | A * | 9/1988 | Ringer | 173/18 |
| 5,027,910 | A * | 7/1991 | Honsa et al. | 173/162.2 |
| 5,163,519 | A * | 11/1992 | Mead et al. | 173/91 |
| 5,407,018 | A * | 4/1995 | Henry | 173/211 |
| 5,553,764 | A * | 9/1996 | Remerowski | 227/10 |
| 5,617,925 | A * | 4/1997 | Boothby et al. | 173/211 |
| 5,749,509 | A * | 5/1998 | Remerowski | 227/10 |
| 6,082,986 | A * | 7/2000 | Seward et al. | 418/270 |
| 6,161,628 | A * | 12/2000 | Liu | 173/168 |
| 6,751,952 | B2 * | 6/2004 | Chen | 60/407 |
| 6,863,134 | B2 * | 3/2005 | Seith et al. | 173/1 |
| 7,238,095 | B1 * | 7/2007 | Sun et al. | 451/344 |
| 7,373,992 | B2 * | 5/2008 | Sterling et al. | 173/169 |
| 7,398,836 | B2 * | 7/2008 | Elmvist et al. | 173/218 |
| 2006/0011366 | A1 * | 1/2006 | Liao | 173/169 |
| 2006/0225905 | A1 * | 10/2006 | Elmvist et al. | 173/197 |
| 2007/0175646 | A1 * | 8/2007 | Preston et al. | 173/13 |
| 2008/0029281 | A1 * | 2/2008 | Sun et al. | 173/104 |
| 2008/0047721 | A1 * | 2/2008 | Chen et al. | 173/15 |
| 2008/0190501 | A1 * | 8/2008 | Yang | 137/625.47 |
| 2011/0036606 | A1 * | 2/2011 | Young et al. | 173/104 |

FOREIGN PATENT DOCUMENTS

WO WO 2004065070 A1 * 8/2004

* cited by examiner

*Primary Examiner* — Rinaldi Rada
*Assistant Examiner* — Robert Long
(74) *Attorney, Agent, or Firm* — Muncy, Geissler, Olds & Lowe, PLLC

(57) ABSTRACT

A pneumatic tool with an improved soundproof device includes a housing whose rear end has a screw hole for supplying a high-pressure gas. The input high-pressure gas drives a pneumatic motor before it leaves the rear end of the housing. A cover covers the rear end of the housing. The cover has a penetrating hole. A guiding element has a guiding section that gradually expands outwards. The guiding element goes through the penetrating hole. An annular ventilation space is formed between the guiding section of the guiding element and the penetrating hole. A gas inlet connector is disposed in the screw hole. The shoulder part of the gas inlet connector stops the guiding element, so that the gas in the ventilation space is guided by the guiding section of the guiding element to escape.

8 Claims, 10 Drawing Sheets

PNEUMATIC TOOL WITH AN IMPROVED SOUNDPROOF DEVICE

BACKGROUND OF THE INVENTION

1. Field of Invention

The invention relates to a pneumatic tool structure and, in particular, to a pneumatic tool with an improved soundproof device.

2. Related Art

The operation principle of a pneumatic tool is to use a high-pressure gas to drive the pneumatic motor therein. Therefore, the pneumatic tool has to have a gas inlet for a gas to enter and a gas outlet for it to leave. Normally, the gas outlet of a pneumatic tool is designed to guide the gas out from the back or from one side. However, there is usually a loud noise when the gas directly leaves the pneumatic tool.

For the design of releasing gas from the back, as shown in FIG. 9, the gas is blocked by the supports 4 between the ventilation holes 2 in the back of the pneumatic tool 1 as it escapes, resulting in turbulences and noises. Moreover, the gas expelled from the back of the pneumatic tool 1 directly hits the quick connector 3 on the back of the pneumatic tool 1. This further increases the noises and produces high-pitched sounds.

FIG. 10 shows a conventional pneumatic tool 1A with side ventilation holes. Indeed, it can avoid the exhaust gas from directly impacting the quick connector (not shown) connected to the rear end of the pneumatic tool. However, the ventilation holes 2A are formed in a matrix form. Therefore, when all the gas leaves via the ventilation holes 2A, there are still collusions between the gas molecules and the supports 4A between adjacent ventilation holes 2A, producing turbulence and high-pitched noises.

In practice, one usually adds silencer cotton to the pneumatic tool whether the gas leaves from the back or the side. However, tests show that the noise intensity can only be reduced to around 82 decibel (dB). Therefore, the prior art still cannot effectively reduce the high-pitched noises produced by the exhaust gas. It is therefore an objective of the invention to solve this problem.

SUMMARY OF THE INVENTION

An objective of the invention is to provide a pneumatic tool with an improved soundproof device. According to the invention, the exhaust gas of the pneumatic tool does not directly impact the quick connector on the rear end thereof. This largely reduces the noises produced by airflow collisions.

To achieve the above objective, the invention includes a housing, a pneumatic motor, a supporting base, a cover, a guiding element, and a gas inlet connector.

The housing is hollow, and has an axial screw hole on its rear end for supplying a high-pressure gas.

The pneumatic motor is disposed inside the housing, with a pneumatic switch disposed on its one side. The high-pressure gas via the screw hole is controlled by the pneumatic switch to rotate the pneumatic motor. The exhaust gas after rotating the pneumatic motor is then expelled from the rear end of the housing.

The supporting base is an annular base with a stop wall therein. The supporting base urges against the rear end of the housing with its stop wall. The central part of the stop wall has an axial through hole, around which is formed with a plurality of axial connecting holes.

The cover covers and positions on the supporting base. The center of the cover has an axial penetrating hole.

The guiding element has an annular shape, a small-diameter end, and a large-diameter end. The guiding element is formed with a guiding section that gradually expands from the small-diameter end to the large-diameter end. The small-diameter end is extended with a small-diameter section. The guiding element goes into the penetrating hole of the cover by its small-diameter section. An annular ventilation space is formed between the guiding section and the penetrating hole.

The gas inlet connector has a head part, a body part, and a shoulder part formed between the head part and the body part. The body part of the gas inlet connector goes in sequence through the guiding element, the penetrating hole, and the through hole, and then into the screw hole. The gas inlet connector is connected to the screw hole. The small-diameter section of the guiding element is correspondingly mounted on the body part of the gas inlet connector. The shoulder part of the gas inlet connector stops at the guiding section of the guiding element.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
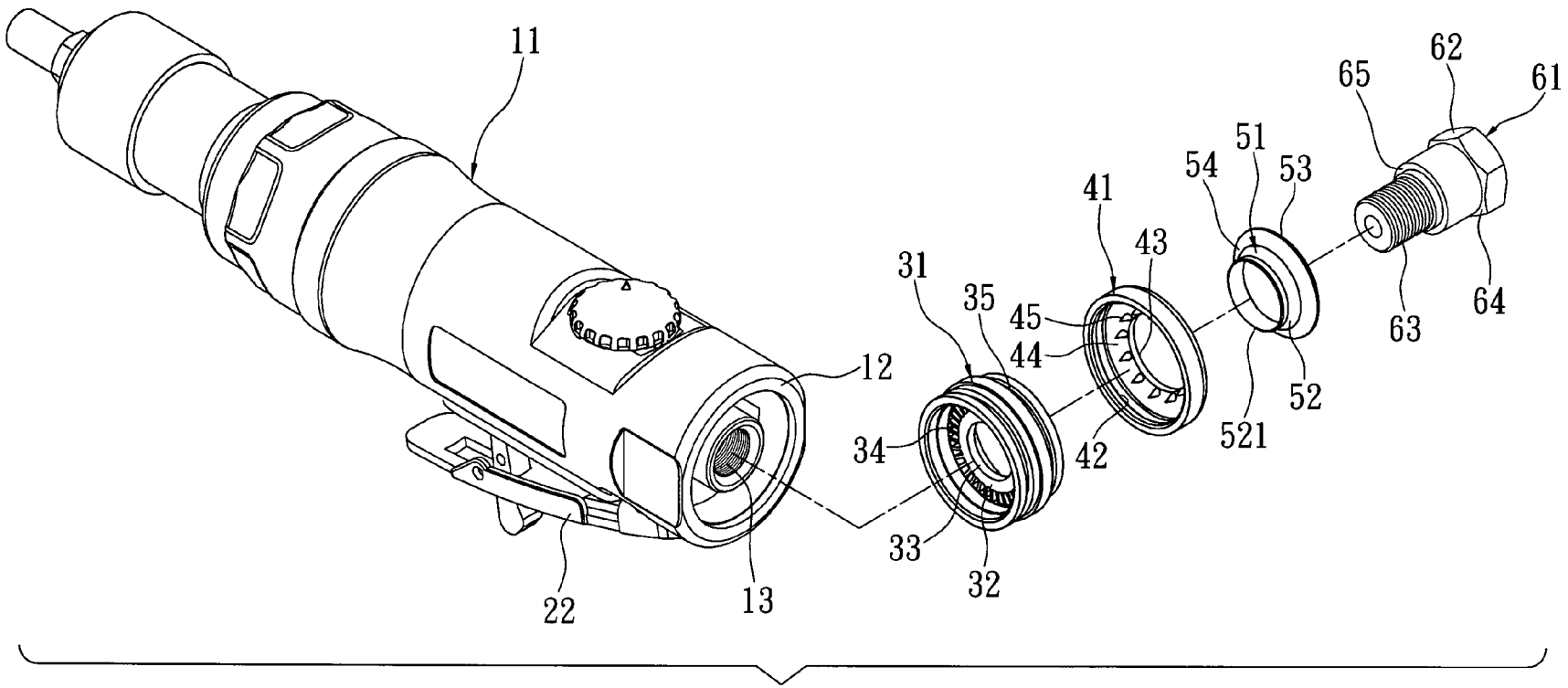
FIG. 1 is a local three-dimensional exploded view of the invention.
Figure 2:
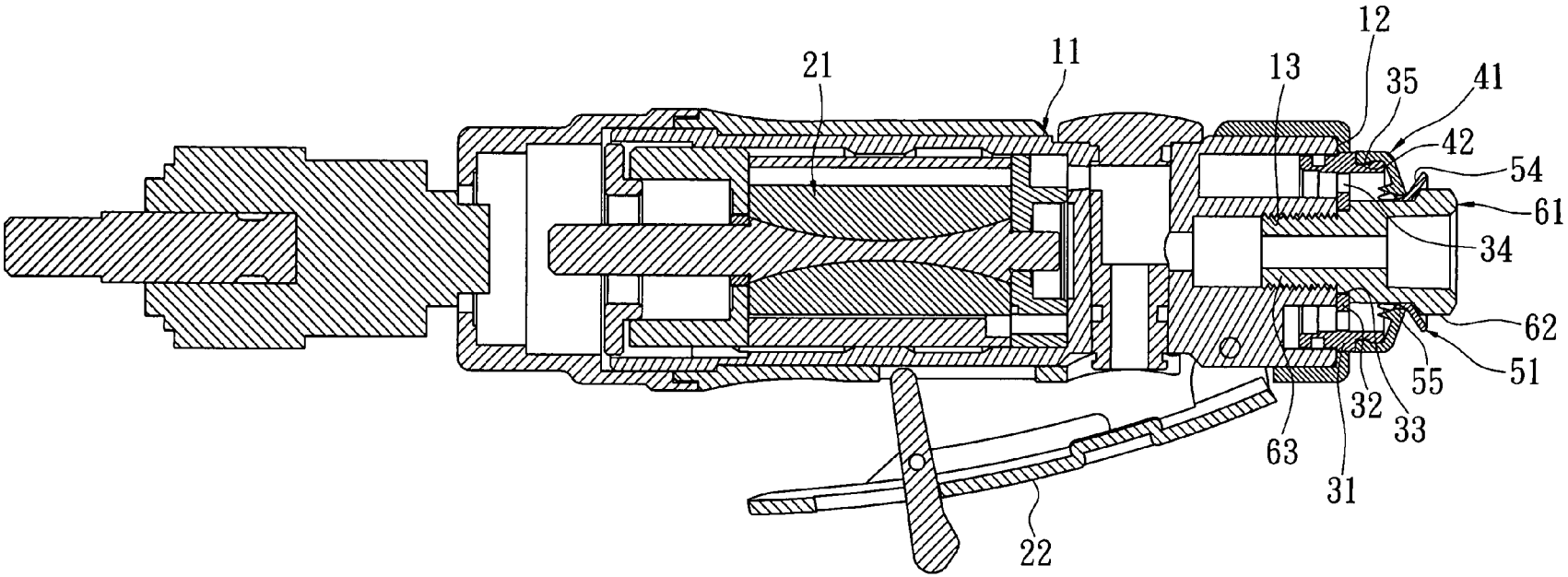
FIG. 2 is a cross-sectional view of the invention.
Figure 3:
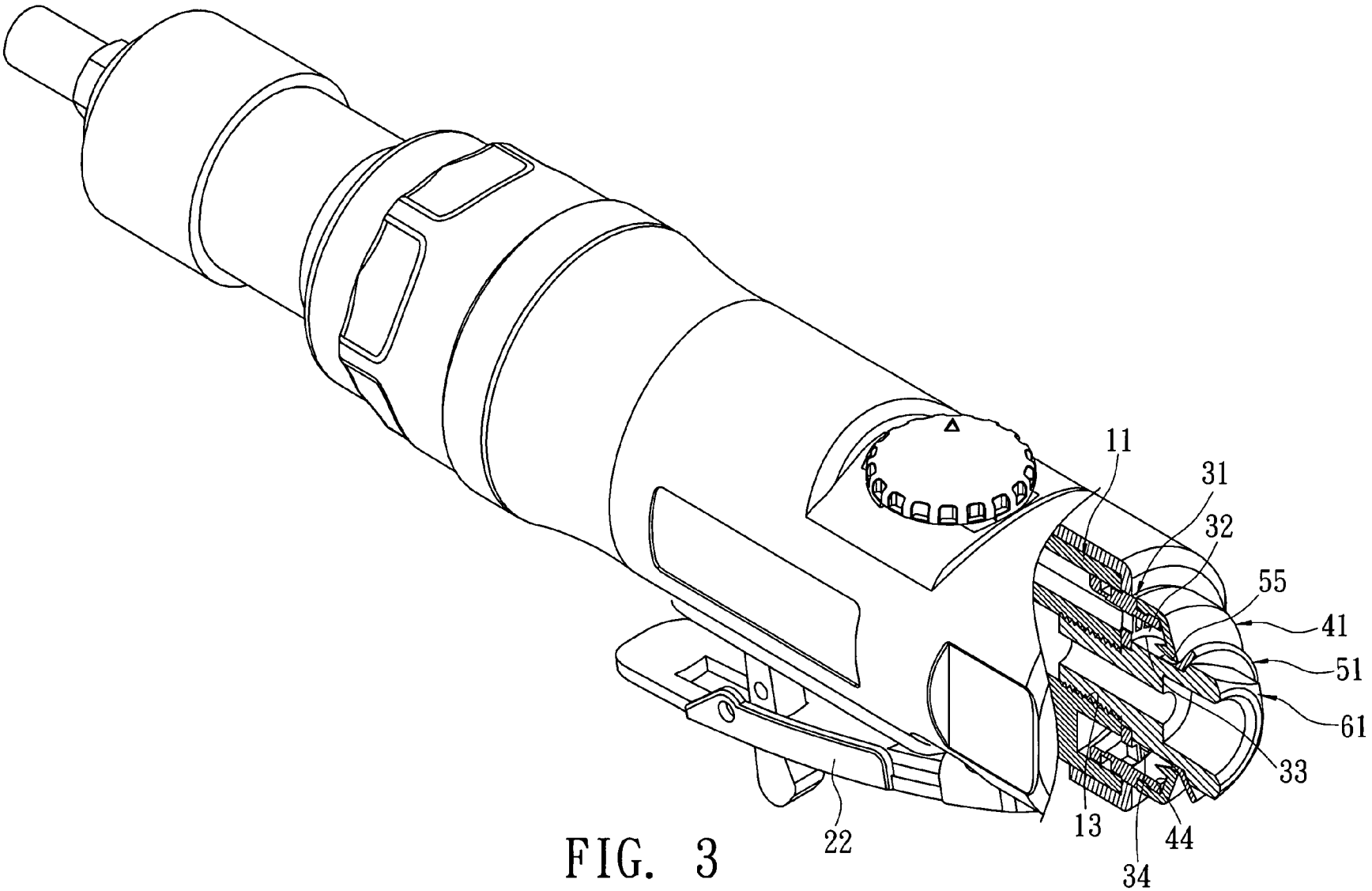
FIG. 3 is a local three-dimensional exploded view of the invention after being assembled.

Please refer to FIGS. 1 to 3. The disclosed pneumatic tool with an improved soundproof device includes a housing 11, a pneumatic motor 21, a supporting base 31, a cover 41, a guiding element 51, and a gas inlet connector 61.

The housing 11 is hollow, and has an axial screw hole 13 on its rear end 12 for supplying a high-pressure gas.

The pneumatic motor 21 is disposed inside the housing 11, with a pneumatic switch 22 disposed on its one side. The high-pressure gas via the screw hole 13 is controlled by the pneumatic switch 22 to rotate the pneumatic motor 21. The exhaust gas after rotating the pneumatic motor 21 is then expelled from the rear end 12 of the housing 11.

The supporting base 31 is an annular base with a stop wall 32 therein. The supporting base urges against the rear end 12 of the housing 11 with its stop wall 32. The central part of the stop wall 32 has an axial through hole 33, around which is formed with a plurality of axial connecting holes 34. The through hole 33 is opposite to the screw hole 13. The outer edge on the other end far from the housing 11 is formed with an annular concave part 35.

The cover 41 has a buckling part 42. The cover 41 holds on to the concave part 35 of the supporting base 31, fixing the cover 41 thereon. The center of the cover 41 has an axial penetrating hole 43. A flow-guiding surface 44 that shrinks towards the penetrating hole 43 is formed on the cover 41. Several conic urging parts 45 that extend towards the supporting base 31 are formed around the penetrating hole 43.

The guiding element 51 has an annular shape, a small-diameter end 52, and a large-diameter end 53. The guiding element is formed with a guiding section 54 that gradually expands from the small-diameter end 52 to the large-diameter end 53. The small-diameter end 52 is extended with a small-diameter section 521. The guiding element 51 goes into the penetrating hole 43 of the cover 41 by its small-diameter section 521. An annular ventilation space 55 is formed between the guiding section 54 and the penetrating hole 43.

The gas inlet connector 61 has a head part 62, a body part 63, and a shoulder part 64 formed between the head part 62 and the body part 63. A pressing part 65 is formed between the shoulder part 64 and the body part 63. The body part 63 of the gas inlet connector 61 goes in sequence through the guiding element 51, the penetrating hole 43, and the through hole 33, and then into the screw hole 13. The gas inlet connector 61 is connected to the screw hole 13. The small-diameter section 521 of the guiding element 51 is correspondingly mounted on the body part 63 of the gas inlet connector 61. The shoulder part 64 of the gas inlet connector 61 stops at the large-diameter section 53 of the guiding element 51 to prevent the guiding element 51 from escape. The pressing part 65 presses upon the rim of the through hole 33 of the supporting base 31. The supporting base 31 is thus urged and fixed on the rear end 12 of the housing 11.

Figure 4:
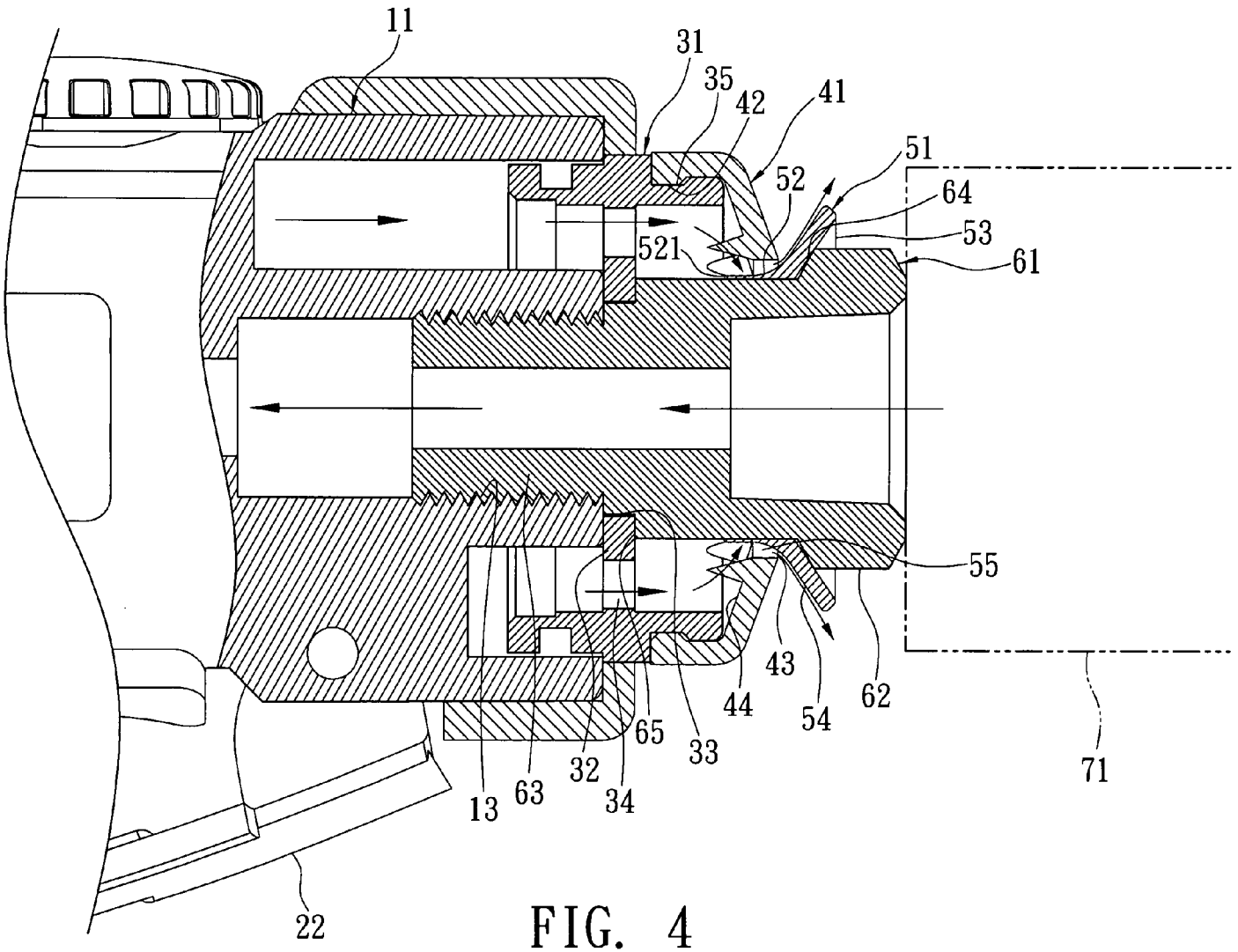
FIG. 4 is a schematic view of the invention in use.

Please refer to FIG. 4. In practice, the gas inlet connector 61 is connected with a quick connector 71 connecting the high-pressure gas pipeline and the gas inlet connector 61. When the high-pressure gas enters via the gas inlet connector 61 to run the pneumatic motor 21, the exhaust gas goes out via the penetrating hole 43 of the cover 41. When the exhaust gas flows through the connecting holes 34 and enters the cover 41, it is guided by the guiding surface 44 of the cover 41 to leave via the annular ventilation space 55 formed between the penetrating hole 43 and the guiding element 51. The exhaust gas out of the ventilation space 55 is further guided by the guiding section 54 of the guiding element 51 to expand outwards in a horn shape.

Using the disclosed technique, the exhaust gas leaving from the back of the pneumatic tool can be homogeneously distributed and avoid the quick connector 71. Since the exhaust gas now does not hit the quick connector 71, the noises can be largely reduced. Moreover, the invention uses a single annular ventilation space 55 for the exhaust gas to more effectively reduce the noise due to exhaust gas turbulences.

Figure 5:
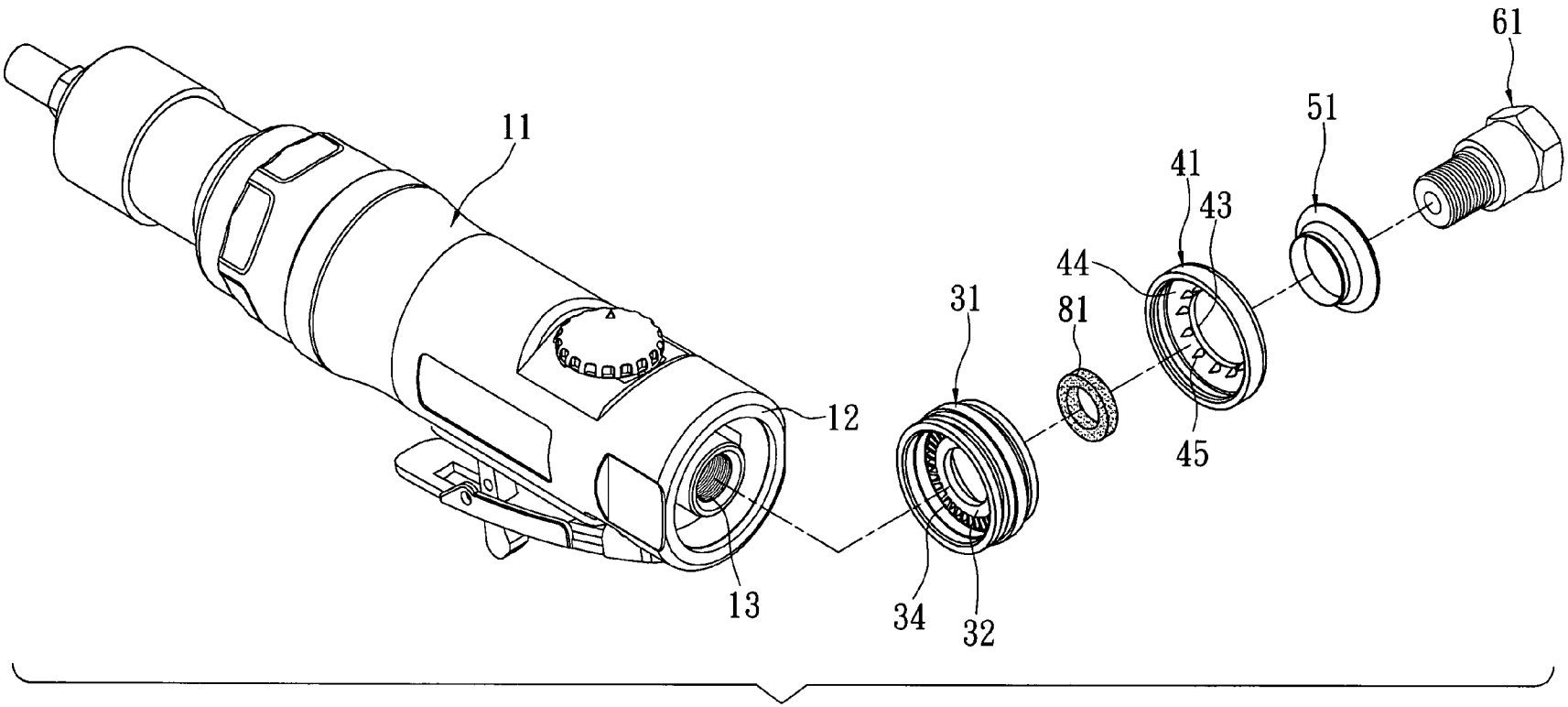
FIG. 5 is a local exploded three-dimensional view according to the second embodiment of the invention.
Figure 6:
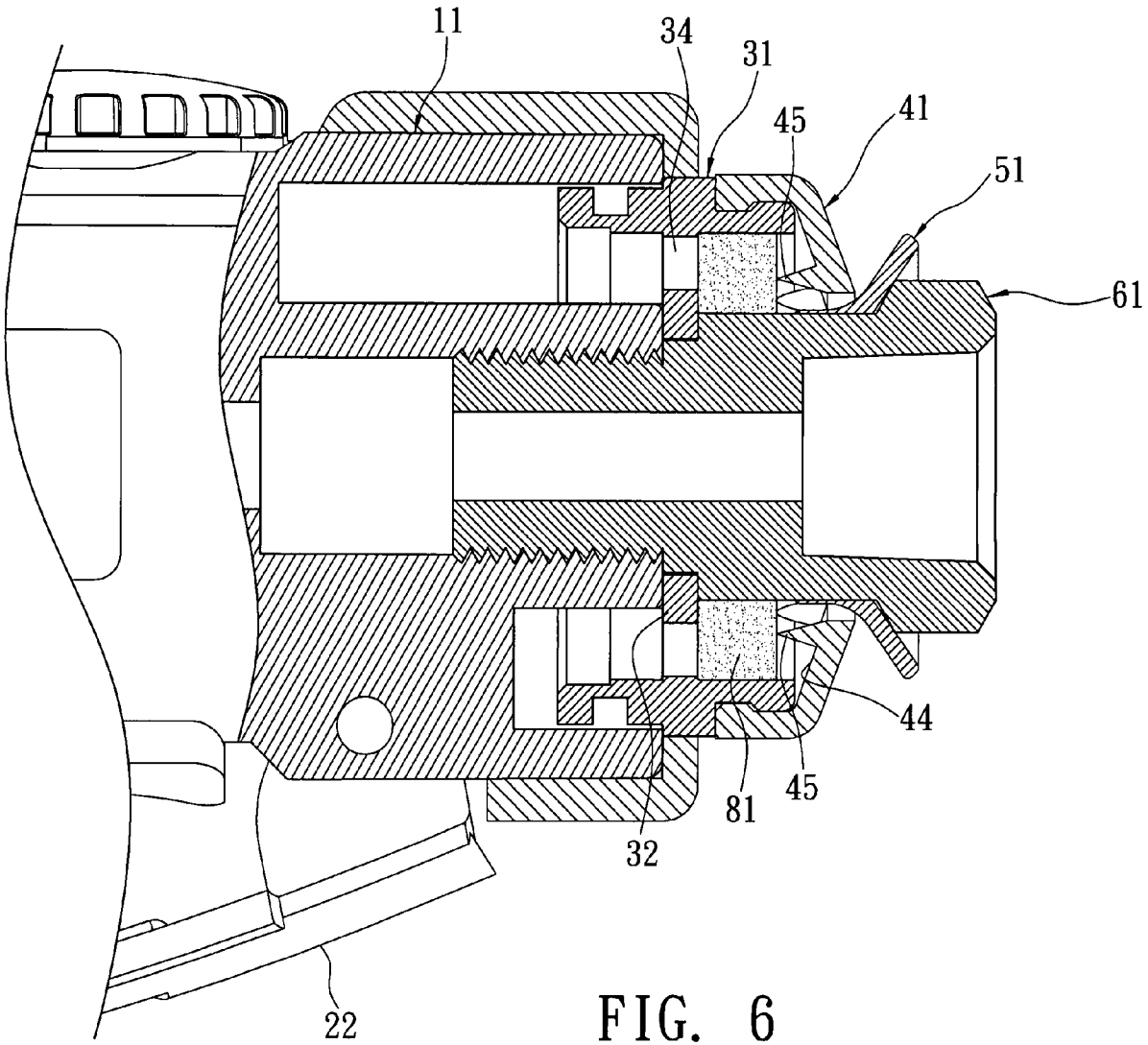
FIG. 6 is a local cross-sectional view according to the second embodiment of the invention.

Please refer to FIGS. 5 and 6 for a second embodiment of the invention. A silencer cotton 81 is interposed between the stop wall 32 of the supporting base 31 and the cover 41 to further reduce noises of the exhaust gas. One end of the silencer cotton 81 urges against the stop wall 32, and the other end thereof is positioned by the urging part 45 of the cover 41, so that it is fixed between the stop wall 32 and the cover 41. This can effectively prevent the silencer cotton 81 from clogging the ventilation space 55 under the outgoing airflow. Indeed, experiments show that the use of silencer cotton 81 can reduce the noises during the operation of invention.

Figure 7:
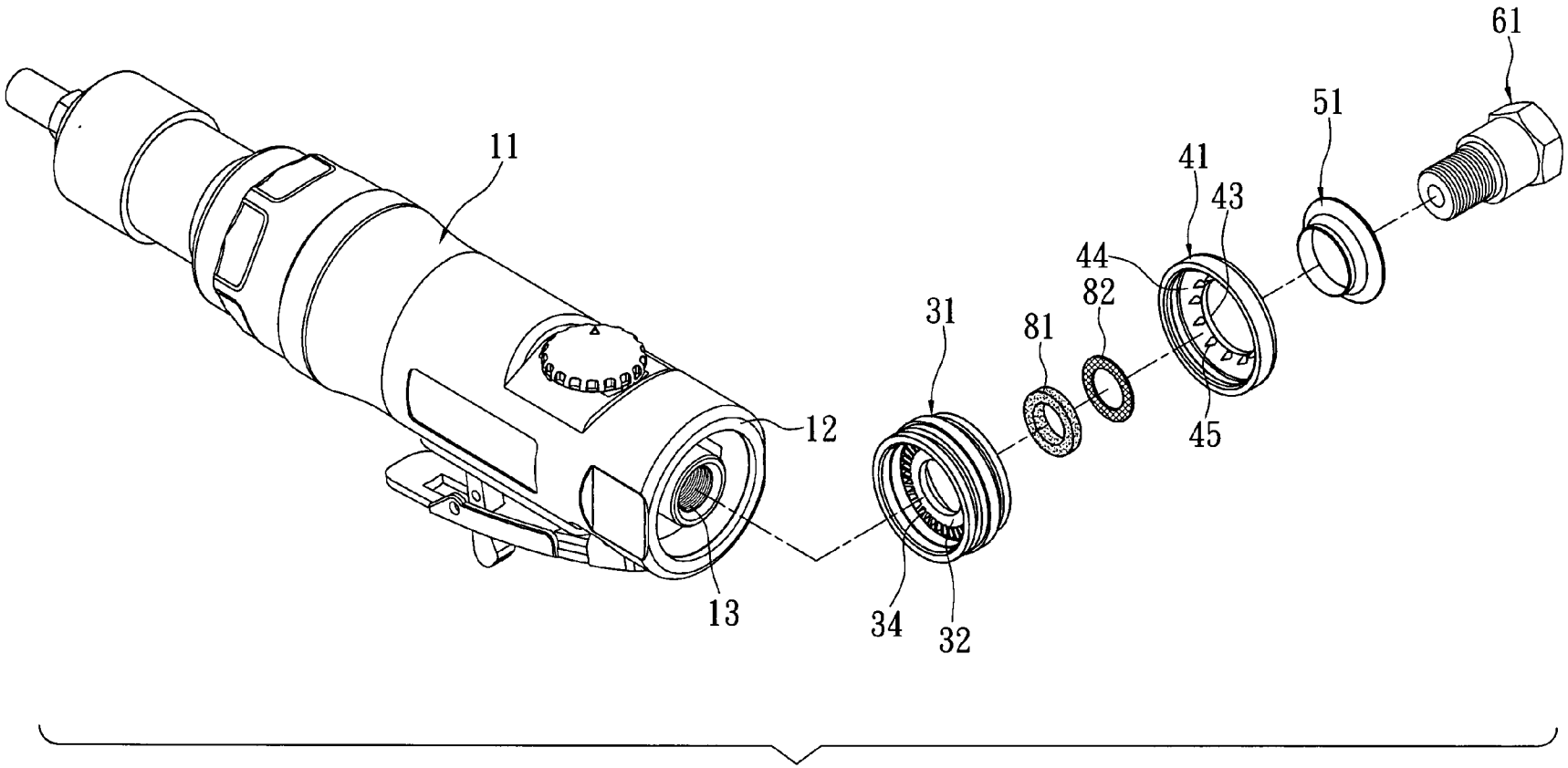
FIG. 7 is a local exploded three-dimensional view according to the third embodiment of the invention.
Figure 8:
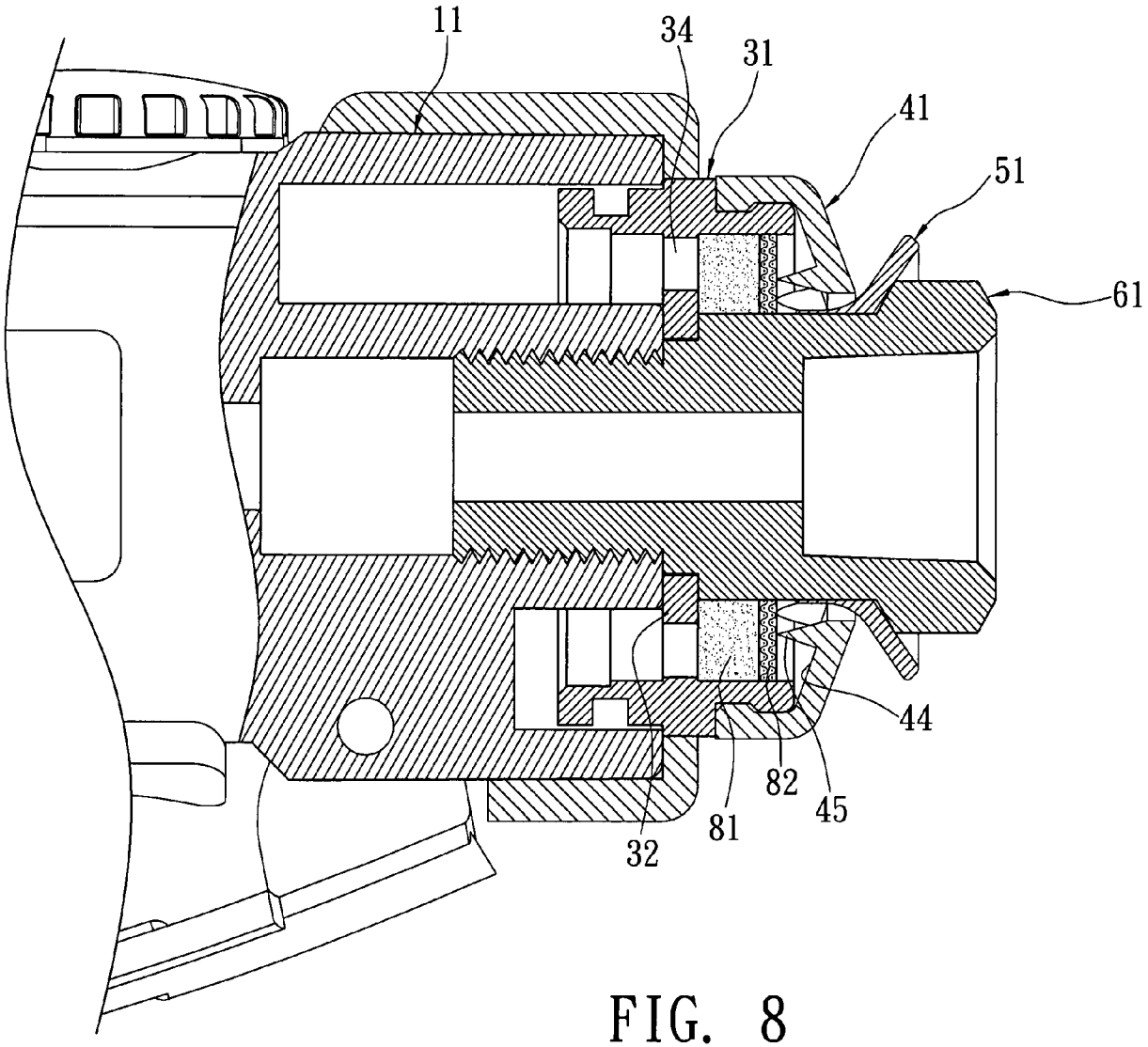
FIG. 8 is a local cross-sectional view according to the third embodiment of the invention.
Figure 9:
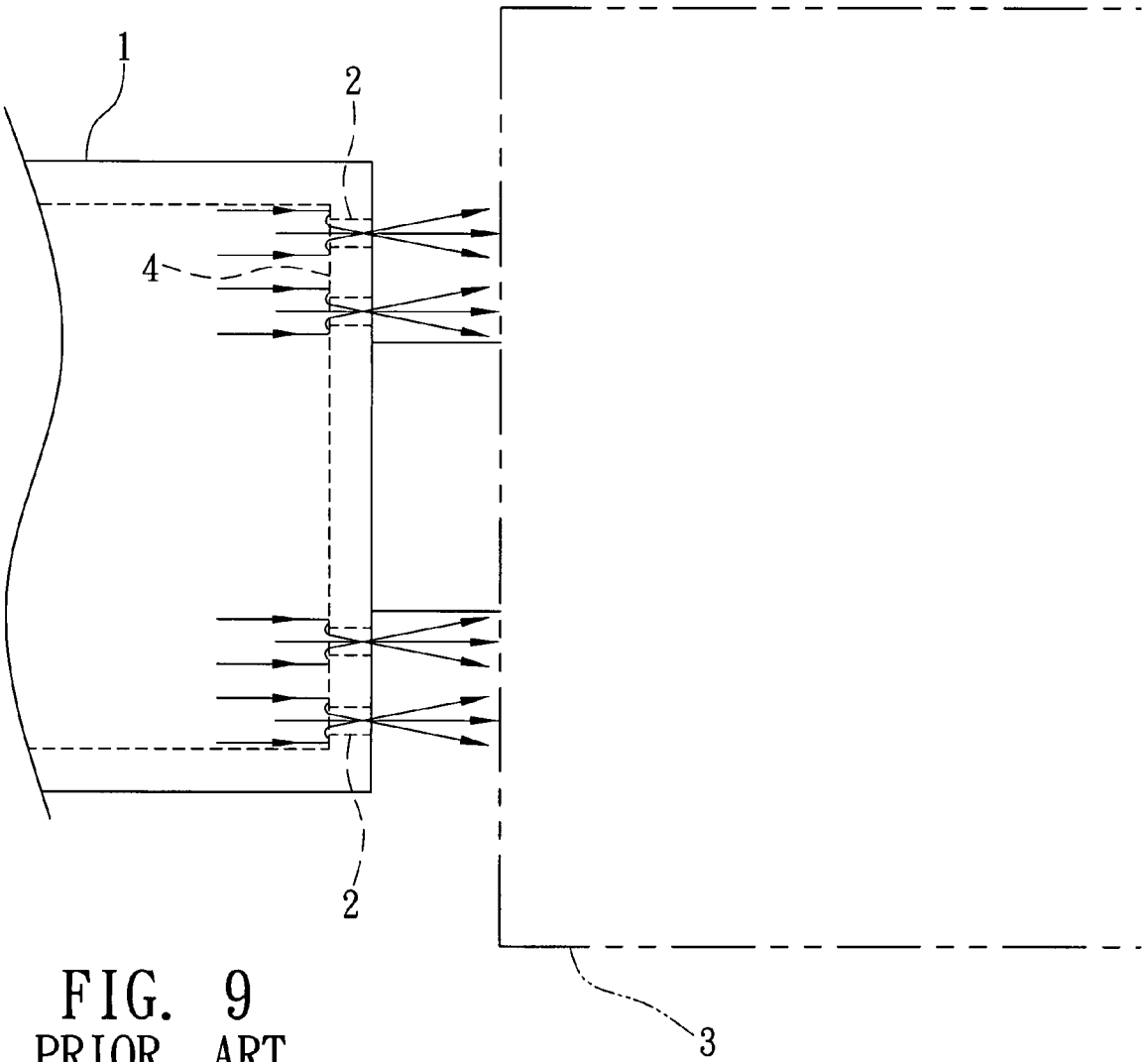
FIG. 9 PRIOR ART
FIG. 9 is a schematic structural view of the pneumatic tool with ventilation holes on the back in the prior art.
Figure 10:
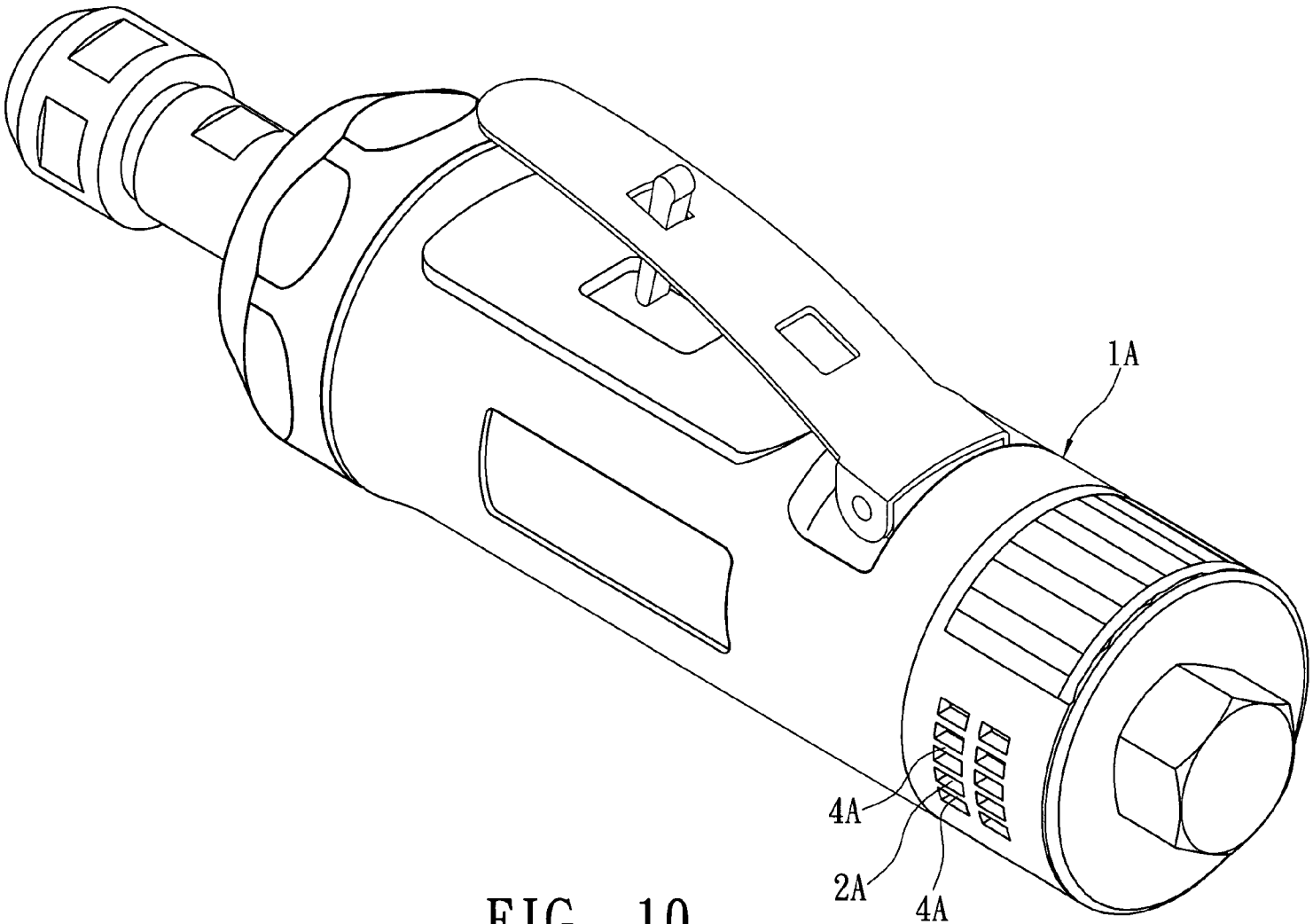
FIG. 10 PRIOR ART
FIG. 10 is a schematic structural view of the pneumatic tool with ventilation holes on one side in the prior art.

FIGS. 7 and 8 show a third embodiment of the invention. This embodiment differs from the second embodiment in that the end of the silencer cotton 81 facing the penetrating hole 43 is further provided with a mesh 82. The mesh 82 is positioned by the urging part 45 in the cover 41. The mesh 82 then further presses on the silencer cotton 81. This achieves the same effect of positioning the silencer cotton 81 as in the second embodiment.

Using the above-mentioned design, the invention can reduce the noises of a pneumatic tool down to 75 decibel (dB).

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An pneumatic tool with an improved sound proof device, comprising:

a housing, which is hollow has an axial screw hole for supplying a high-pressure gas on the rear end thereof;

an pneumatic motor, which is disposed in the housing with an pneumatic switch provided on one side thereof; wherein the high-pressure gas entered via the screw hole is controlled by the pneumatic switch to drive the pneumatic motor, and the exhaust gas after driving the pneumatic motor leaves the housing from its rear end;

a supporting base, which has an annular base that has a stop wall therein; wherein the supporting base urges against the rear end of the housing by the stop wall, the center of the stop wall has an axial through hole, and a plurality of axial connecting holes are formed around the penetrating hole;

a cover, which covers and fixes on the supporting base and whose center is formed with an axial penetrating hole;

a guiding element, which has an annular shape and has a small-diameter end and a large-diameter end, with a guiding section gradually expanding from the small-diameter end to the large-diameter end; a gas exit passageway being in contact with and defined in part by the guiding element, the small-diameter end is further extended with a small-diameter section that goes into the penetrating hole of the cover, and an annular ventilation space is formed between the guiding section of the guiding element and the penetrating hole; and a gas inlet connector, which has a head part, a body part, and a shoulder part between the head part and the body part; wherein the body part of the gas inlet connector penetrates in sequence through the guiding element, the penetrating hole, and the through hole and into the screw hole; the small-diameter section of the guiding element mounts on the body part of the gas inlet connector connected in the screw hole, and the shoulder part of the gas inlet connector stops the guiding section of the guiding element, whereby gas is supplied to the pneumatic motor through the gas inlet connector and is vented from the pneumatic tool through the gas exit passageway and the annular ventilation space, the guiding section of the guiding element changing a direction of gas flow, wherein a longitudinal axis passes through the gas inlet connector and the guiding section of the guiding element vents gas in a direction non-parallel to the longitudinal axis, and wherein a plurality of conic urging parts are provided on an interior of the cover, the interior of the cover being a flow-guiding surface which is a part of the gas exit passageway and the conic urging parts directing the flow of gas.

2. The pneumatic tool with an improved soundproof device of claim 1, wherein the supporting base is plugged to the rear end of the housing using its one end, the other end of the supporting base far from the housing is formed with a concave part on the outer edge, and the cover has a buckling part corresponding to the concave part of the supporting base.

3. The pneumatic tool with an improved soundproof device of claim 1, wherein the end of the cover with the penetrating hole is formed with a flow guiding surface that gradually shrinks towards the penetrating hole.

4. The pneumatic tool with an improved soundproof device of claim 1, wherein a pressing part is formed between the shoulder part and the body part of the gas inlet connector, the pressing part presses around the through hole of the supporting base when the gas inlet connector is disposed in the screw hole, thereby urging the supporting base and fixing it on the rear end of the pneumatic tool.

5. The pneumatic tool with an improved soundproof device of claim 1, wherein the annular ventilation space is an annular opening which surrounds the gas inlet connector.

6. The pneumatic tool with an improved soundproof device of claim 1, wherein the guiding section of the guiding element vents gas in a direction non-perpendicular and non-parallel to the longitudinal axis.

7. The pneumatic tool with an improved soundproof device of claim 1, wherein the flow-guiding surface is angled to reduce a size of the gas exit passageway towards the axial penetrating hole.

8. The pneumatic tool with an improved soundproof device of claim 1, wherein the supporting base is provided between the cover and the gas inlet, the supporting base, the cover and the gas inlet being linearly aligned.

* * * * *